US005129530A

United States Patent [19]

Fuchs

[11] Patent Number: 5,129,530

[45] Date of Patent: Jul. 14, 1992

[54] TAMPER INDICATING CLOSURE

[75] Inventor: Timothy J. Fuchs, Perrysburg, Ohio

[73] Assignee: Owens-Illinois Closure Inc., Toledo, Ohio

[21] Appl. No.: 756,397

[22] Filed: Sep. 9, 1991

[51] Int. Cl.[5] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,458,822 | 7/1984 | Ostrowsky | 215/252 |
| 4,497,765 | 2/1985 | Wilde et al. | 264/268 |
| 4,530,436 | 7/1985 | Wiedmer | 215/246 |
| 4,545,496 | 10/1985 | Wilde et al. | 215/252 |
| 4,588,100 | 5/1986 | Itsubo et al. | 215/252 |

*Primary Examiner*—Stephen Marcus

*Assistant Examiner*—Nova Stucker

[57] ABSTRACT

A tamper indicating closure comprising a base wall, a peripheral skirt and a band connected with the skirt along a weakened line. The band includes portions that are adapted to engage an annular retaining bead on a container to which the closure is applied. The closure includes a thin membrane extending axially along the lower portion of the skirt, spanning the weakened line and through the band. A thickened band retention column extends radially inwardly from the inner surface of the lower portion of the skirt adjacent the thin membrane, and axially spans the weakened line and extends radially outwardly into the band. When the closure is removed from its position on the container, the score line and thin membrane are broken but the band retention column retains the band on the closure and indicates that the closure has been tampered with.

6 Claims, 2 Drawing Sheets

TAMPER INDICATING CLOSURE

This invention relates to tamper indicating closures and particularly to tamper indicating closures which include a tamper indicating band that is retained on the closure after the closure is removed from the container on which it is applied.

BACKGROUND AND SUMMARY OF THE INVENTION

It is common to provide tamper indicating closures to indicate when a closure has been removed from a container. Typically, one type of such closures includes a tamper indicating band that is attached to the skirt of the closure along a weakened line and has means for engaging a retaining bead on a container. When the closure is removed, the retaining bead restricts movement of the tamper indicating band causing the band to be severed. Typical tamper indicating closures of this type are shown in U.S. Pat. Nos. 33,265 and 4,653,657.

It has also been suggested that tamper indicating bands be provided with means for retaining the bands on the closures.

Among the objectives of the present invention are to provide a tamper indicating closure having a novel construction for retaining the tamper band on the closure while still providing visual evidence of the closure having been removed from the container; which the closure is readily manufactured without additional manipulative steps such as selective scoring; and which can be provided by the molding operation of forming the closure.

In accordance with the invention, a tamper indicating closure comprising a base wall, a peripheral skirt and a band connected with the skirt along a weakened line. The band includes portions that are adapted to engage an annular retaining bead on a container to which the closure is applied. The closure includes a thin membrane extending axially along the lower portion of the skirt, spanning the weakened line and through the band. A thickened band retention column extends radially inwardly the inner surface of the lower portion of the skirt adjacent the thin membrane, and axially spans the weakened line and extends radially outwardly into the band When the closure is removed from its position on the container, the score line and thin membrane are broken but the band retention column retains the band on the closure and indicates that the closure has been tampered with.

DESCRIPTION

Figure 1:
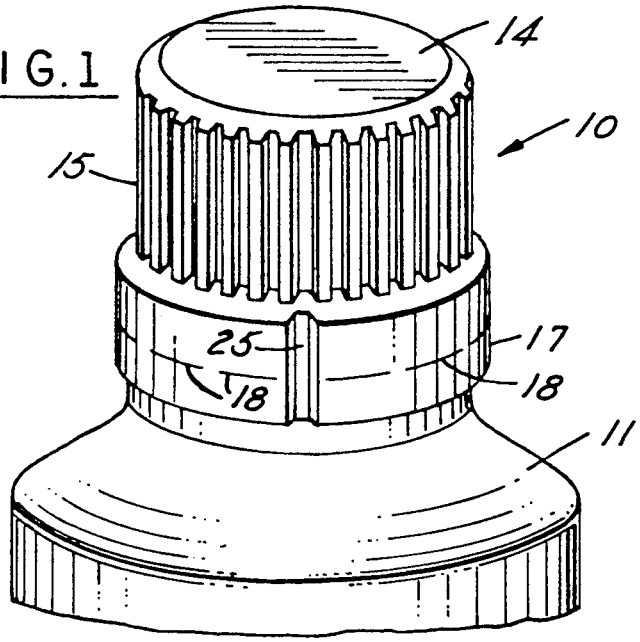
FIG. 1 is a fragmentary perspective view of a closure and container embodying the invention.
Figure 2:
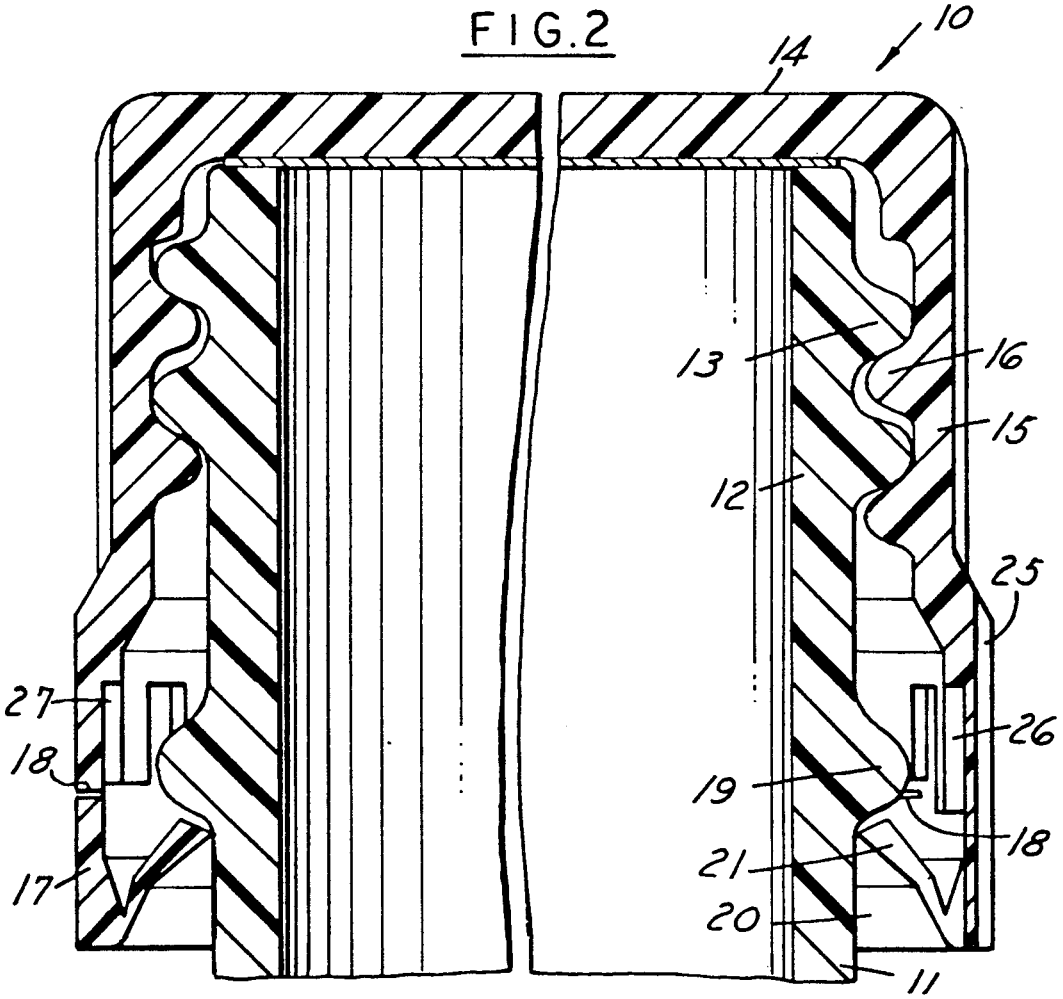
FIG. 2 is a fragmentary vertical sectional view thereof on an enlarged scale.
Figure 3:
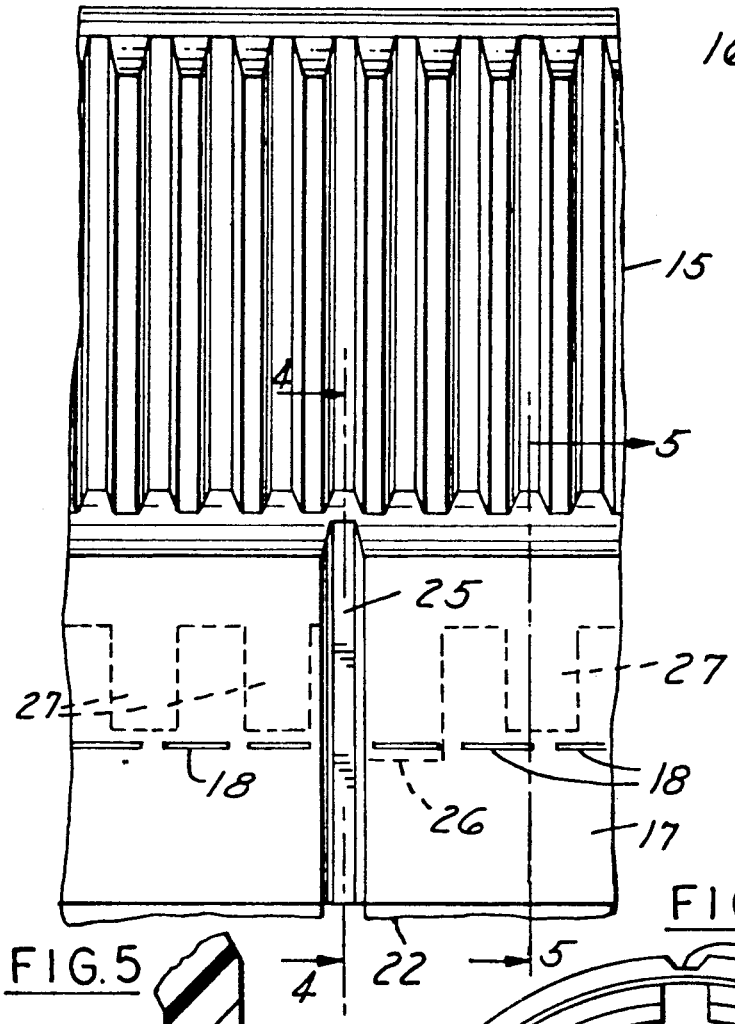
FIG. 3 is a fragmentary elevational view of a portion of the closure after molding and prior to folding the tamper indicating band into operative position.
Figure 4:
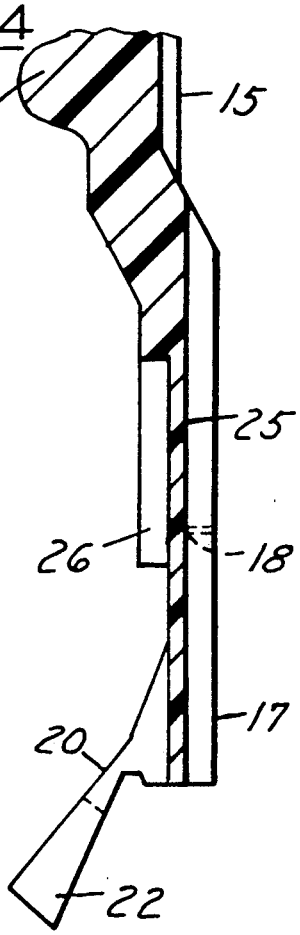
FIG. 4 is a fragmentary sectional view taken along the line 4—4 in FIG. 3.
Figure 5:
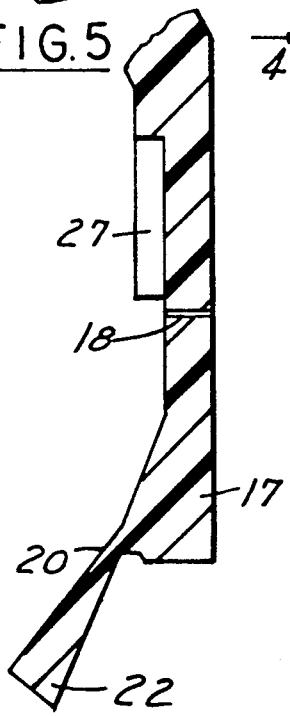
FIG. 5 is a fragmentary sectional view taken along the line 5—5 in FIG. 3.
Figure 6:
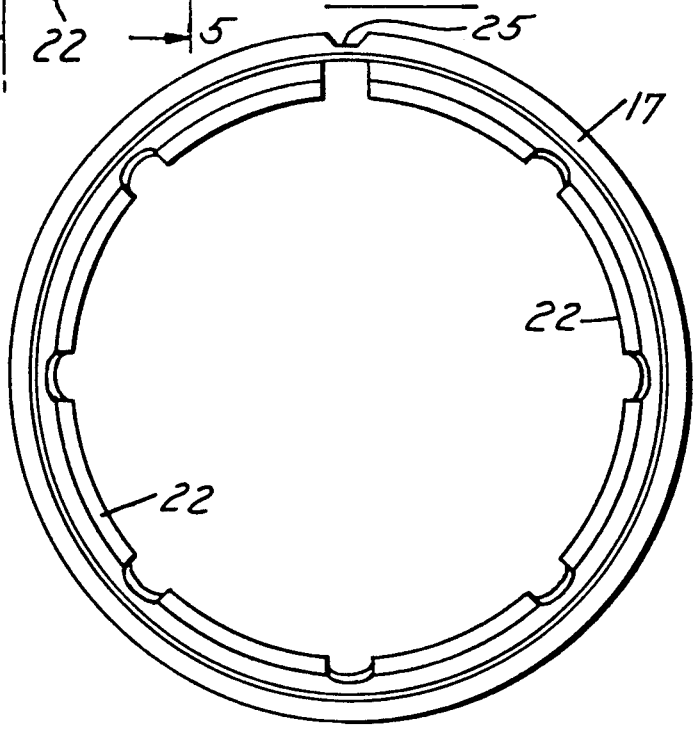
FIG. 6 is a bottom plan view of the closure shown in FIG. 3.

Referring to FIGS. 1 and 2, the invention comprises a plastic closure 10 and a container 11 having a finish 12 with external threads 13. The closure comprises a base wall 14 and a peripheral skirt 15 having internal threads 16 for engaging the threads 13 on the finish. A tamper indicating band 17 is connected to the skirt 15 of the closure by weakened line 18 formed by an interrupted score line. The band 17 includes retention means for retaining the band on a retainer bead 19 of a closure, herein shown as an annular flange including a first portion 20 hinged to band and a second portion 21 formed at an angle to the first portion 20 and being segmented by slots 22 as shown in co-pending application Ser. No. 07/386,391 filed Jul. 27, 1989 having a common assignee with the present application, incorporated herein by reference. Such closures are made of plastic such as polypropylene.

In accordance with the invention, a thin web 25 is provided axially and spans the lower portion of the skirt 15 of the closure and the entire axial width of the band 17. A portion of flange portion 21 is interrupted opposite the web 25.

A band retention column 26 is provided on the interior surface of the lower portion of the skirt adjacent the thin membrane, and extends radially inwardly and axially and spans the score line 18 into the band 17.

A plurality of circumferentially spaced support columns 27 are provided on the lower portion of the skirt above the score line 18 and terminate above the score line 18.

When the closure is molded, it is in the position shown in FIGS. 3–6 but after molding, the band retention means 20 is folded inwardly to the position shown in FIG. 2.

When the closure is applied to the finish 12 of the container 11, the retention means on the band engage beneath the retention bead 18 on the container retaining the closure on the container 11.

When the closure is unthreaded to remove the closure from the container 11, the retention means causes the bridges formed by the score line 18 to be fractured. At the same time, the thin membrane 25 is fractured. However, the band retention column 26 retains the band 17 to the skirt 15 while at the same time giving visual evidence that the closure has been removed or tampered with.

It can thus be seen that there has been provided a tamper indicating closure having a novel construction for retaining the tamper band on the closure while still providing visual evidence of the closure having been removed from the container; which the closure is readily manufactured without additional manipulative steps such as selective scoring; and which can be provided by the molding operation of forming the closure.

I claim:

1. A tamper indicating closure comprising a base wall, a peripheral skirt and a band connected with the skirt along a weakened line, said band including means that are adapted to engage an annular retaining bead on a container to which the closure is applied, said closure including a thin membrane extending axially along the lower portion of the skirt, spanning the weakened line and through the band, the thickness of said membrane being less than the thickness of the adjacent portions of said skirt, a thickened band retention column extending along the inner surface of the lower portion of the skirt adjacent the thin membrane, spanning the weakened line and extending into the band, such that when the closure is removed from its position on the container, the weakened line and the thin membrane are broken but the band retention column retains the band on the closure and indicates that the closure has been tampered with.

2. The tamper indicating closure set forth in claim 1 wherein said band retention column is of generally uniform width and thickness.

3. The tamper indicating closure set forth in claim 2 wherein said band retention column is rectangular in cross section.

4. The tamper indicating closure set forth in claim 1 wherein said weakened line comprises an interrupted score line.

5. The tamper indicating closure set forth in claim 1 including a plurality of circumferentially spaced support columns on the interior surface of the lower portion of the skirt of the closure extending axially and terminating above the score line.

6. The tamper indicating closure set forth in any of claims 1-5 including a container having a retaining means thereon adapted to be engaged by the means on the tamper indicating band.

* * * * *